US007309265B2

(12) United States Patent
Takada et al.

(10) Patent No.: US 7,309,265 B2
(45) Date of Patent: Dec. 18, 2007

(54) OUTBOARD MOTOR STEERING SYSTEM

(75) Inventors: Hideaki Takada, Wako (JP); Taiichi Otobe, Wako (JP); Shinsaku Nakayama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 158 days.

(21) Appl. No.: 11/215,110

(22) Filed: Aug. 30, 2005

(65) Prior Publication Data

US 2006/0052013 A1 Mar. 9, 2006

(30) Foreign Application Priority Data

Sep. 3, 2004 (JP) ..... 2004-256585

(51) Int. Cl.
*B63H 21/22* (2006.01)

(52) U.S. Cl. ..... 440/1; 440/53

(58) Field of Classification Search ..... 440/1, 440/53

See application file for complete search history.

(56) References Cited

U.S. PATENT DOCUMENTS

2002/0042233 A1* 4/2002 Michel et al. ..... 440/38
2004/0139903 A1* 7/2004 Watabe et al. ..... 114/144 R
2004/0147179 A1* 7/2004 Mizuno et al. ..... 440/1

FOREIGN PATENT DOCUMENTS

JP 5221385 8/1993

* cited by examiner

*Primary Examiner*—Stephen Avila
(74) *Attorney, Agent, or Firm*—Carrier, Blackman & Associates, P.C.; Joseph P. Carrier; William D. Blackman

(57) ABSTRACT

In an outboard motor steering system, the engine speed is detected as a value indicative of the speed of the boat and a current value for operating a steering hydraulic cylinder is determined to decrease with decreasing engine speed. The current value can therefore be determined in accordance with the steering load to reduce electric power consumption. Moreover, owing to the fact that the drive current is determined as a function of steering load, it is possible to prevent the output of the cylinder from becoming excessive relative to the steering load, thereby ensuring that the steered angle tracks a desired steering angle with good accuracy.

8 Claims, 8 Drawing Sheets

OUTBOARD MOTOR STEERING SYSTEM

BACKGROUND OF THE INVENTION

1. Field of the Invention

This invention relates to an outboard motor steering system.

2. Description of the Related Art

One example of a conventional outboard motor steering system that uses an actuator such as an electric motor to regulate the steering angle of an outboard motor can be found in Japanese Laid-Open Patent Application No. Hei 5(1993)-221385. In this technique, electric power consumption is reduced by supplying less drive current to an actuator during non-steering than during steering.

In the outboard motor steering system, when the engine speed of the outboard motor is raised to increase the thrust produced by the propeller, the steering load is increased owing to higher water resistance. In addition, as the thrust grows larger, the speed (particularly the water speed) of the boat rises to increase the water pressure acting on the rudder section of the outboard motor, thus further increasing the steering load.

The usual practice is therefore to supply an adequately large amount of drive current to the steering actuator so as to enable stable steering when the steering load becomes large. When this is done, however, the amount of drive current supplied to the steering actuator during low-speed cruising (when the steering load is small) becomes larger than necessary. Room for power conservation therefore remains.

Moreover, when drive current is supplied in such a large amount that the actuator output becomes excessive relative to the steering load, the change in steering angle overshoots the desired steering angle. This degrades the steering convergence property and has a bad effect on steering performance.

SUMMARY OF THE INVENTION

An object of this invention is therefore to overcome the foregoing drawback by providing an outboard motor steering system in which the amount of drive current supplied to the steering actuator is determined as a function of steering load, thereby reducing electric power consumption and also enabling the steering angle to track the desired steering angle with good accuracy.

In order to achieve the object, this invention provides a system for steering an outboard motor adapted to be mounted on a stern of a boat and having an internal combustion engine to power a propeller, comprising: an actuator which regulates a steering angle of the outboard motor; a detector which detects a speed of the boat; a current value determiner which determines a current value to be supplied to the actuator based on the detected speed of the boat; and an actuator controller which controls operation of the actuator based on the determined current value.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

A preferred embodiment of an outboard motor steering system according to the invention will now be explained with reference to the attached drawings.

Figure 1:
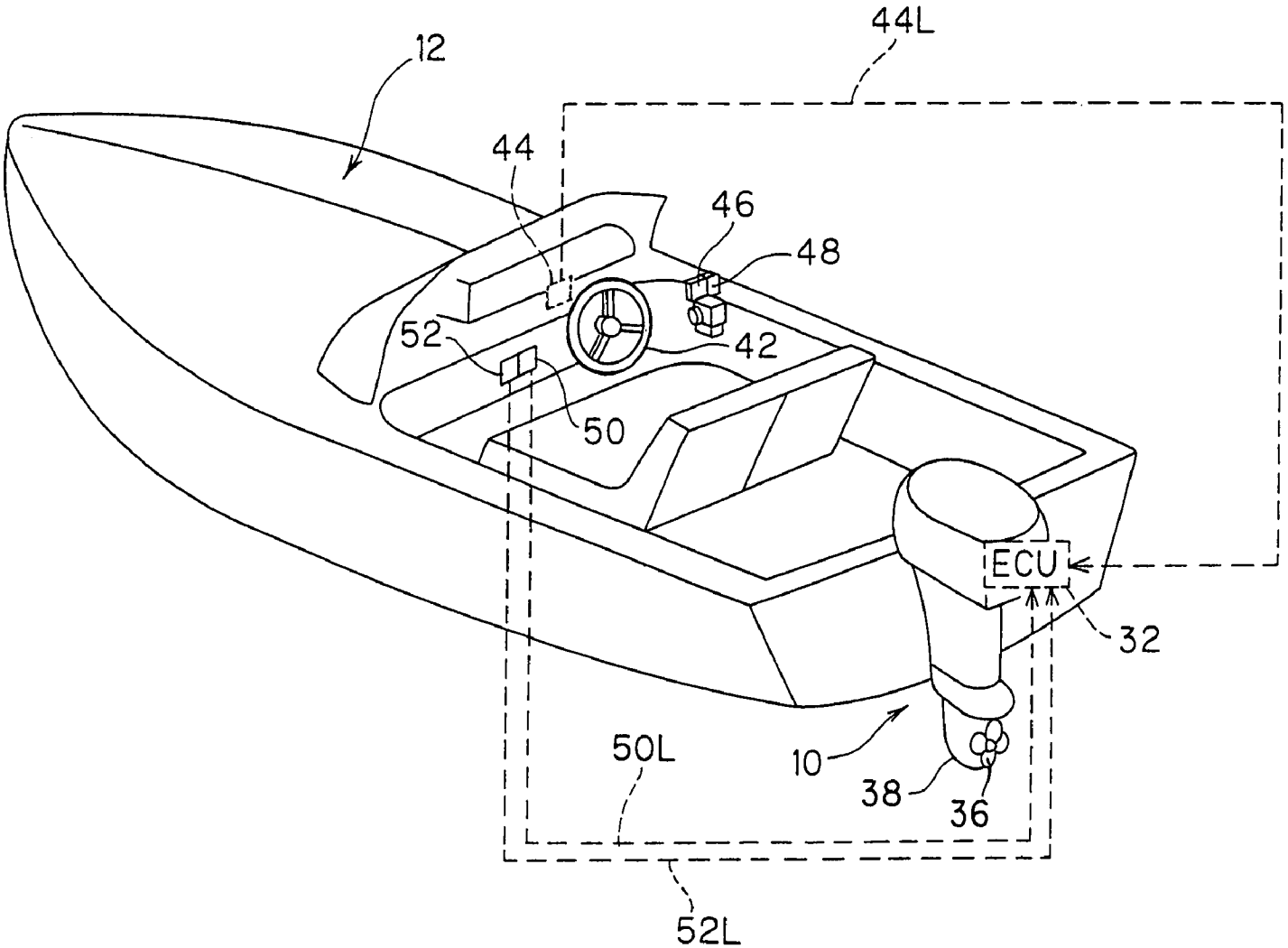
FIG. 1 is an overall schematic view of an outboard motor steering system including a boat (hull) according to an embodiment of the invention.
Figure 2:
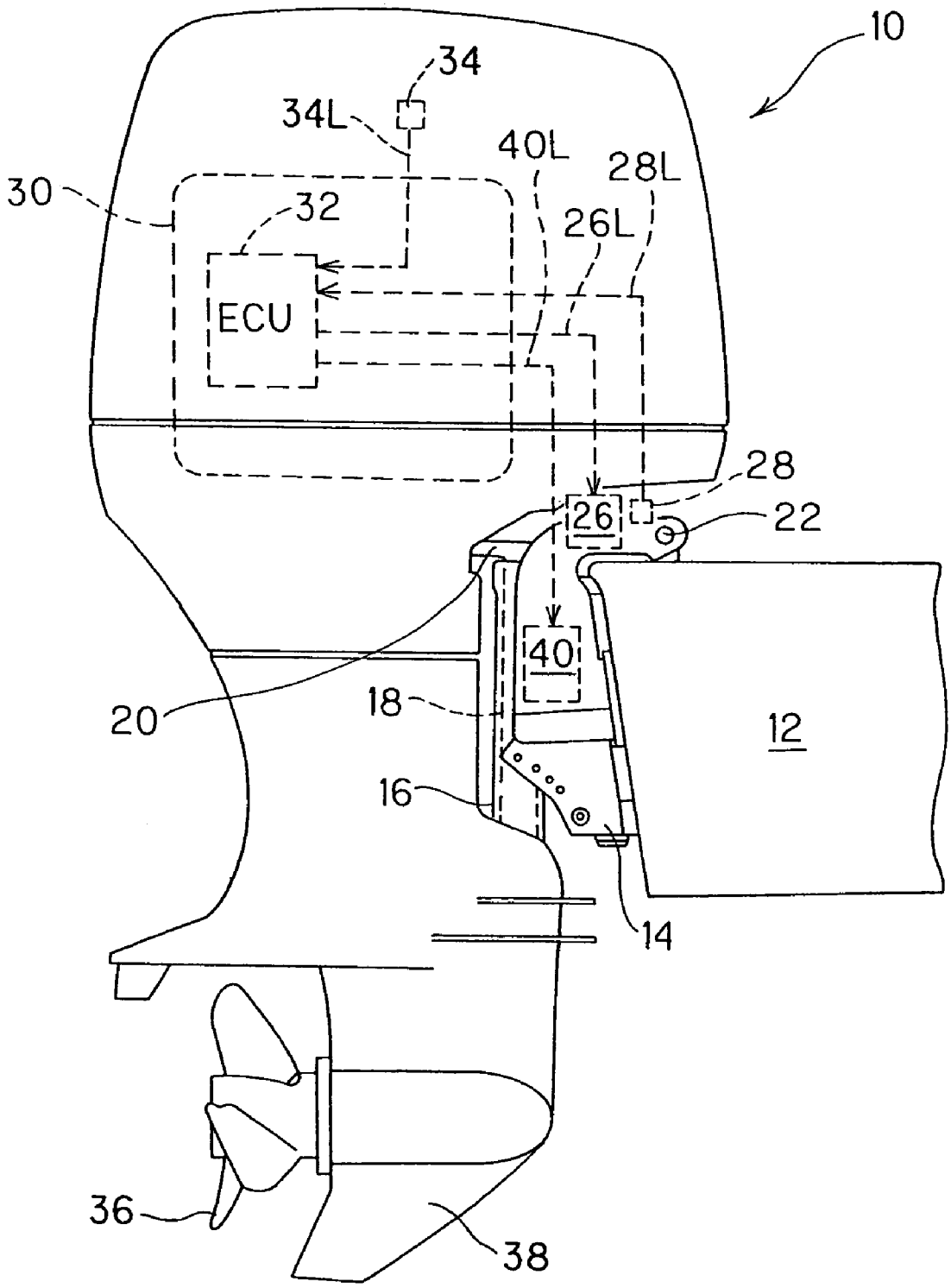
FIG. 2 is a side view of the outboard motor shown in FIG. 1.

FIG. 1 is an overall schematic view of an outboard motor steering system including a boat (hull) according to an embodiment of the invention, and FIG. 2 is a side view of the outboard motor shown in FIG. 1.

In FIGS. 1 and 2, the symbol 10 indicates an outboard motor. As shown in FIG. 2, the outboard motor 10 is mounted on the stern (transom) of a boat (hull) 12 through stern brackets 14 fastened to the stern of the boat 12, a swivel case 16 attached to the stern brackets 14 and a swivel shaft 18 rotatably housed in the swivel case 16.

The swivel shaft 18 that is rotatably housed in the swivel case 16 is connected at its upper end to a frame of the outboard motor 10 through a mount frame 20, and at is lower end to the frame of the outboard motor 10. The swivel case 16 is attached to the stern brackets 14 through a tilting shaft 22. With this, the outboard motor 10 is operated to be freely steered about the swivel shaft 18 as a rotational axis with respect to the boat 12 and stern brackets 14, and to freely perform tilt up/down or trim up/down about the tilting shaft 22 as a rotational axis.

The upper portion of the swivel case 16 is installed with a hydraulic cylinder (actuator; hereinafter referred to as the "steering hydraulic cylinder") 26 that regulates a steering angle of the outboard motor 10. A stroke sensor 28 attached to the steering hydraulic cylinder 26 outputs or generates a signal indicative of a driven or operated amount of the steering hydraulic cylinder 26 (i.e., the steered angle of the outboard motor 10).

An internal combustion engine (hereinafter referred to as the "engine") 30 is disposed in the upper portion of the outboard motor 10. The engine 30 comprises a spark-ignition, in-line, four-cylinder, four-cycle gasoline engine with a displacement of 2,200 cc. An electronic control unit (ECU) 32 comprising a microcomputer is disposed near the engine 30.

A crank angle sensor 34 is installed near the crank shaft (not shown) of the engine 30. The crank angle sensor 34 outputs or generates a signal every predetermined crank angle (e.g., 30 degrees).

A propeller 36 and a rudder 38 are provided at the lower portion of the outboard motor 10. The propeller 36 is rotated by the power of the engine 30 which is transmitted via a crankshaft, drive shaft, shift mechanism (none of which is shown), thereby generating a thrust.

An actuator, specifically a known power tilt-trim unit 40, for regulating a tilt angle and trim angle is installed near the stern brackets 14 and swivel case 16. The above-mentioned steering hydraulic cylinder 26, stroke sensor 28, crank angle sensor 34 and power tilt-trim unit 40 are connected to the ECU 32 via signal lines 26L, 28L, 34L and 40L, respectively.

As shown in FIG. 1, a steering wheel 42 is installed near the cockpit (operator's seat) of the boat 12, and a steering angle sensor 44 is installed near the steering wheel 42. The steering angle sensor 44 comprising a rotary encoder outputs or generates a signal in response to the steered angle (manipulated variable) of the steering wheel 42 manipulated by the operator.

A shift lever 46 and a throttle lever 48 installed near the operator's seat are connected to the shift mechanism and to a throttle valve (not shown) of the engine 30 through push-pull cables. Specifically, the manipulation of the shift lever 46 causes the shift mechanism to operate, thereby changing the moving direction of the boat 12. Further, the manipulation of the throttle lever 48 causes the throttle valve to open and close, thereby regulating the engine speed.

A power tilt switch 50 for inputting an instruction by the operator to regulate the tilt angle and a power trim switch 52 for inputting an instruction by the operator to regulate the trim angle of the outboard motor 10 are also installed near the cockpit. These switches 50 and 52 generate or output signals in response to tilt up/down and trim up/down instructions input by the operator. The steering angle sensor 44, power tilt switch 50 and power trim switch 52 are connected to the ECU 32 via signal lines 44L, 50L and 52L, respectively.

The ECU 32 counts the outputs from the crank angle sensor 34 sent over the signal line 34L and detects or calculates the engine speed NE as a value indicating or corresponding to the speed of the boat 12 (boat speed; more specifically water speed). Based on the outputs from the stroke sensor 28 and steering angle sensor 44 sent over the signal lines 28L and 44L and the detected engine speed NE, the ECU 32 controls the operation of the steering hydraulic cylinder 26 to regulate the steering angle of the outboard motor 10. The control of the steering hydraulic cylinder 26 will be later explained in detail. Further, based on the outputs from the power tilt switch 50 and power trim switch 52 sent over the signal lines 50L and 52L, the ECU 32 controls the operation of the power tilt-trim unit 40 to regulate the tilt/trim angle of the outboard motor 10.

Figure 3:
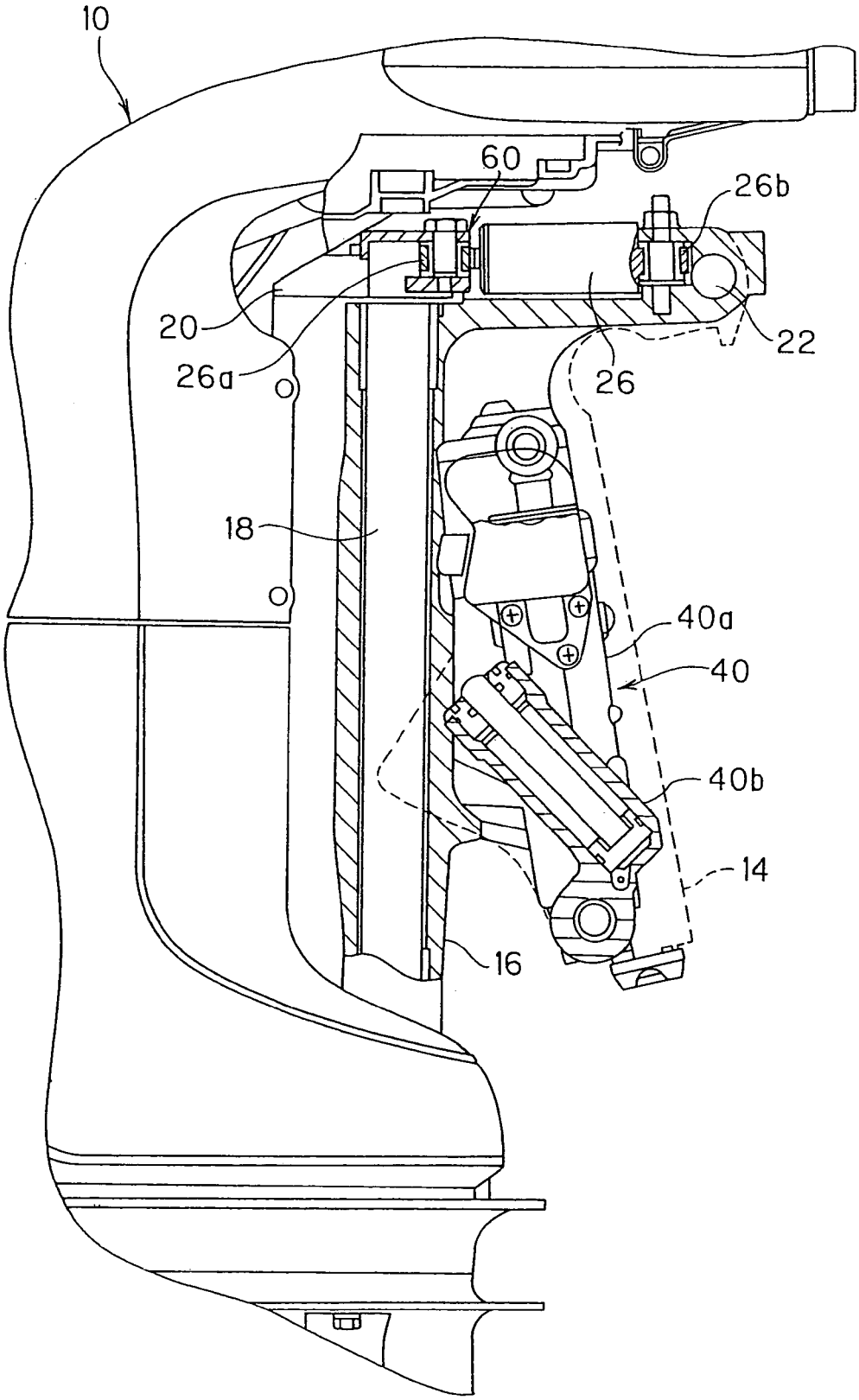
FIG. 3 is an enlarged partial sectional view of portions around a swivel case shown in FIG. 2.

FIG. 3 is an enlarged partial sectional view showing the swivel case 16 shown in FIG. 2.

As illustrated in FIG. 3, the power tilt-trim unit 40 integrally comprises a hydraulic cylinder for adjusting the tilt angle (hereinafter called the "tilt hydraulic cylinder") 40*a*, and two hydraulic cylinders for adjusting the trim angle (hereinafter called the "trim hydraulic cylinders") 40*b*. A cylinder bottom of the tilt hydraulic cylinder 40*a* is fastened to the stern brackets 14 and a rod head thereof abuts on the swivel case 16. A cylinder bottom of each trim hydraulic cylinder 40*b* is fastened to the stern brackets 14 and a rod head thereof abuts on the swivel case 16. Thus, when the tilt hydraulic cylinder 40*a* or the trim hydraulic cylinders 40*b* are driven (extend and contract), the swivel case 16 rotates about the tilting shaft 22 as a rotational axis, thereby regulating the tilt/trim angle of the outboard motor 10.

Figure 4:
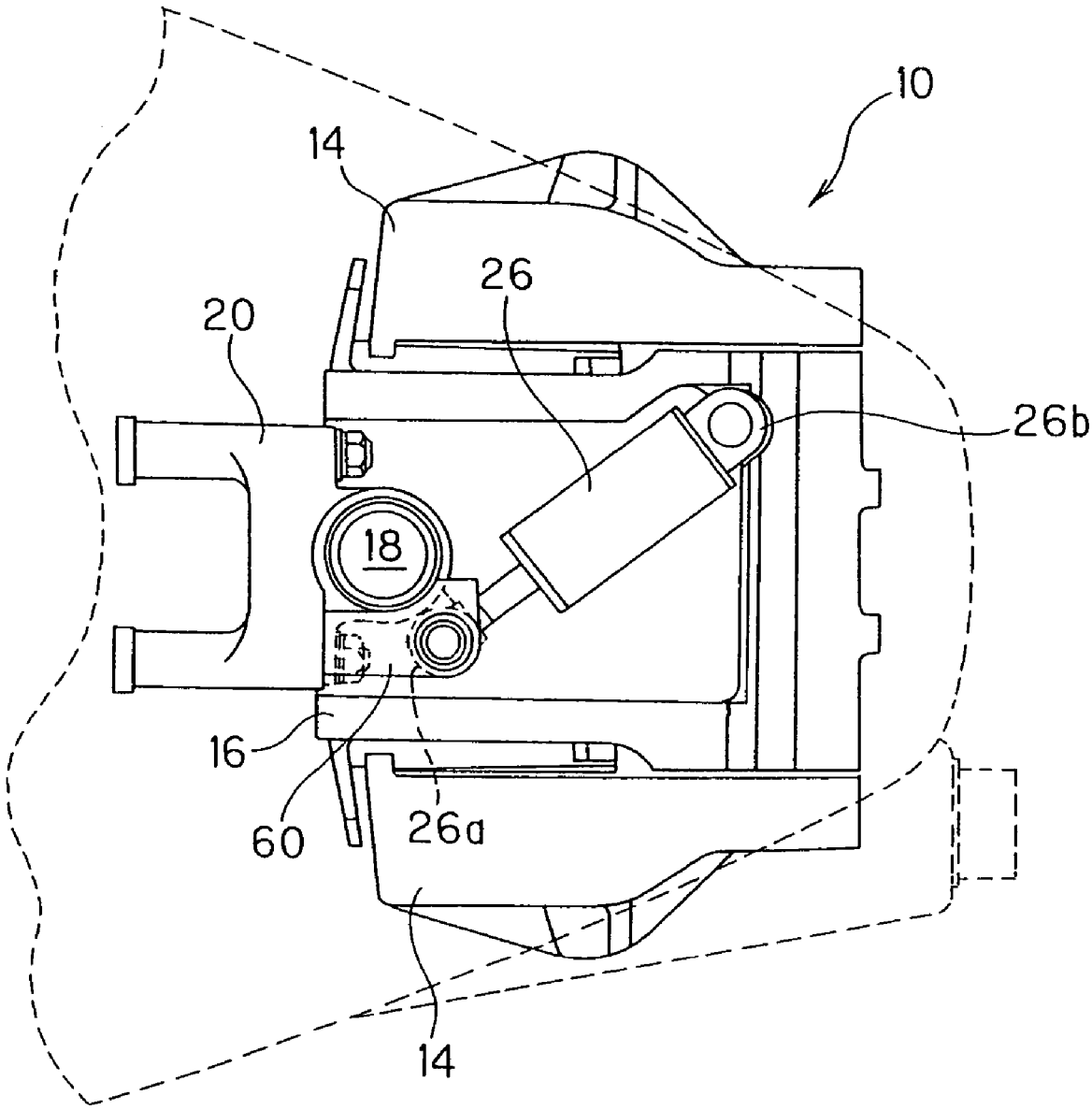
FIG. 4 is a plan view of the swivel case shown in FIG. 3 viewed from the top.

FIG. 4 is a plan view of the swivel case 16 viewed from the top.

As shown in FIGS. 3 and 4, the mount frame 20 is provided with a stay 60 at a location immediately above the swivel shaft 18 or thereabout. A rod head 26*a* of the steering hydraulic cylinder 26 is rotatably attached to the stay 60 and a cylinder bottom 26*b* thereof is rotatably attached to the upper portion of the swivel case 16. With this, the driving of the steering hydraulic cylinder 26 causes the mount frame 20 and swivel shaft 18 to rotate, thereby steering the outboard motor 10 to the right and left directions.

Figure 5:
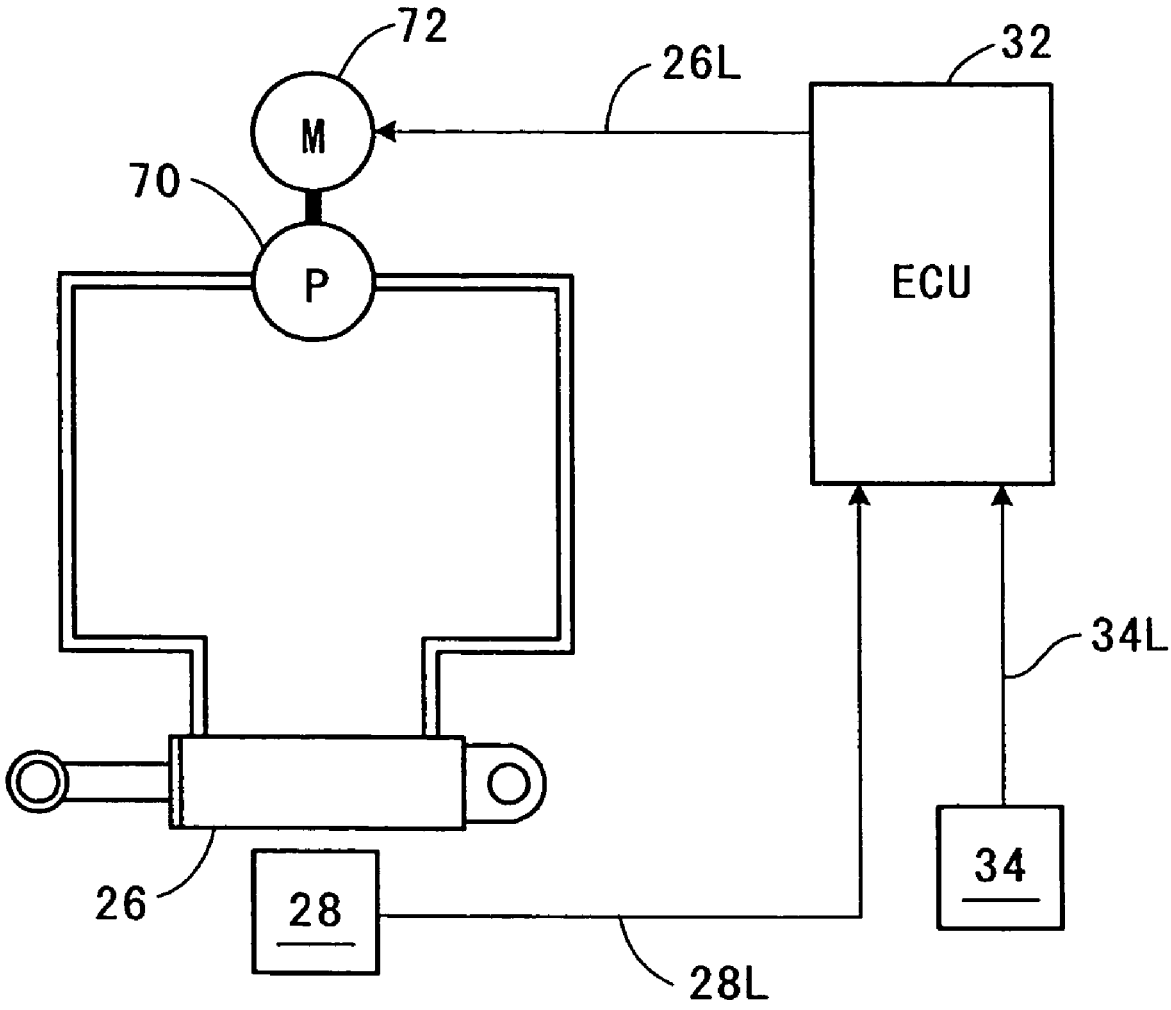
FIG. 5 is a block diagram showing the configuration of the outboard motor steering system shown in FIG. 1.

FIG. 5 is a block diagram showing the configuration of the outboard motor steering system according to this embodiment.

As shown in FIG. 5, a hydraulic pump 70 is connected to the steering hydraulic cylinder 26 for delivering hydraulic fluid thereto. The hydraulic pump 70 is connected to and driven by an electric motor 72. The signal line 26L mentioned earlier interconnects the electric motor 72 and the ECU 32. The ECU 32 controls the operation of the electric motor 72 based on the outputs of the aforesaid sensors, thereby operating the hydraulic pump 70 so as to control the operation of the steering hydraulic cylinder 26.

Figure 6:
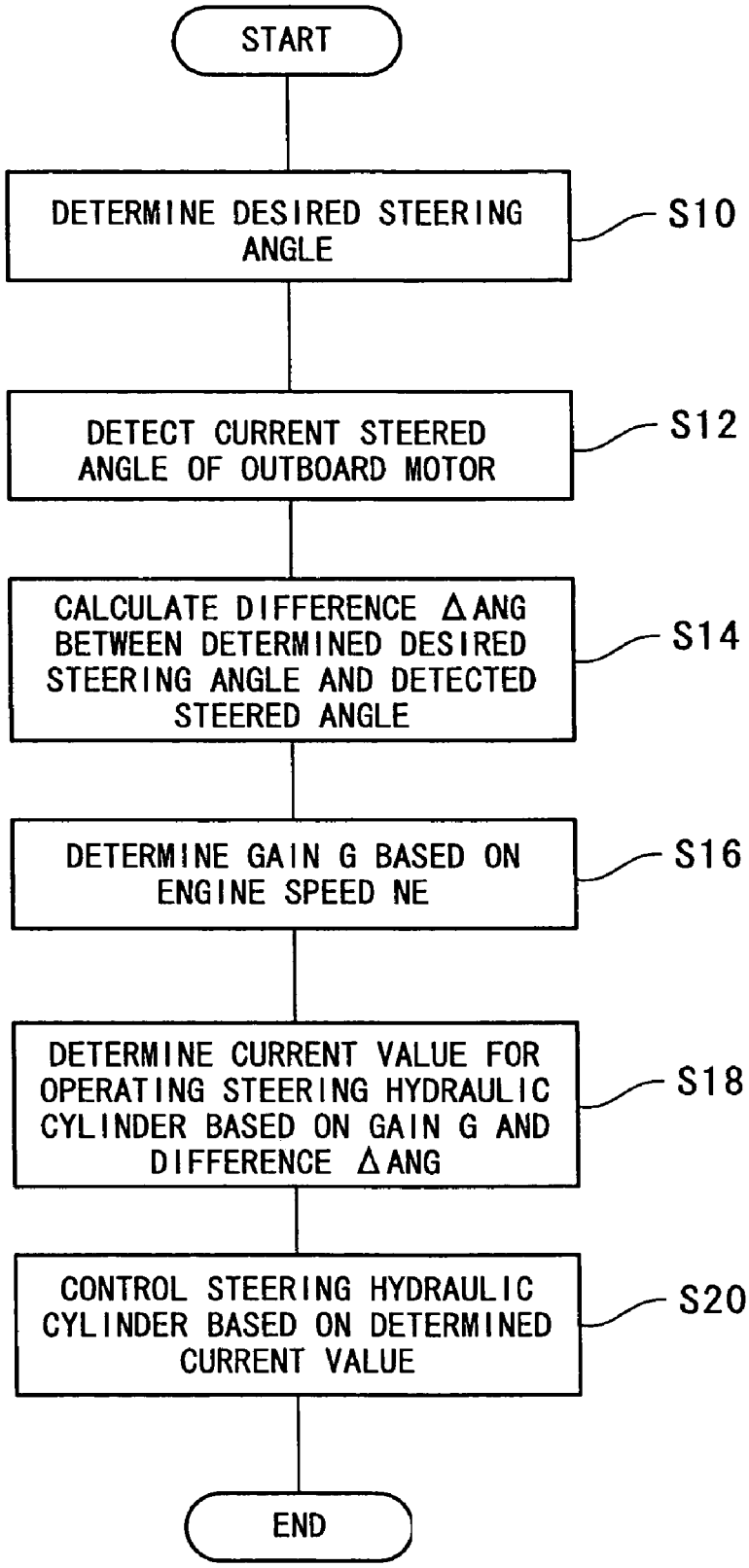
FIG. 6 is a flowchart showing the sequence of steps in the operation of the outboard motor steering system shown in FIG. 1.

FIG. 6 is a flowchart showing the sequence of steps in the operation of the outboard motor steering system according to this invention. The routine of this flowchart is executed in the ECU 32 at prescribed intervals of, for example, 10 msec. The control of the steering hydraulic cylinder 26 (i.e., the control of the electric motor 72) will now be explained with reference to FIGS. 6 to 8.

First, in S10, a desired steering angle of the outboard motor 10 is determined based on the steered angle of the steering wheel 42 detected by the steering angle sensor 44. For example, where the maximum steering angle of the outboard motor 10 is 30 degrees to the left and 30 degrees to the right (total of 60 degrees) and maximum steered angle of the steering wheel 42 is 360 degrees to the left and 360 degrees to the right (total of 720 degrees), the desired steering angle is increased or decreased 1 degree per 12 degrees of rotation of the steering wheel 42.

Next, in S12, the current or actual steered angle of the outboard motor 10 is detected from the output of the stroke sensor 28, whereafter, in S14, the difference or deviation ΔANG between the desired steering angle and the current steered angle is calculated. Next, in S16, a gain G is determined or calculated based on the engine speed NE.

Figure 7:
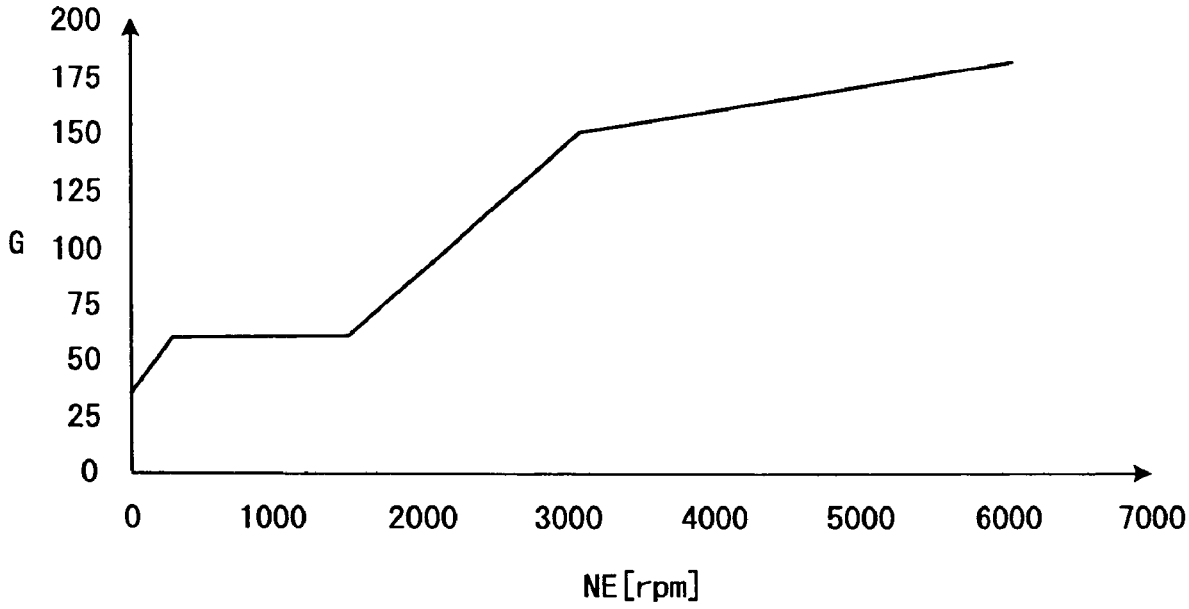
FIG. 7 is a graph showing a characteristic curve of a gain set with respect to an engine speed, that is used in processing of the flowchart shown in FIG. 6.

FIG. 7 is a graph showing a characteristic curve of the gain G set relative to the engine speed NE. As shown, the gain G is set or defined to decrease as the engine speed NE decreases. The gain G corresponds, for example, to at least one among a P term, I term and D term in the sense of a PID control.

Next, in S18 of the flowchart of FIG. 6, the electric current value for operating the steering hydraulic cylinder 26 is determined based on the gain G and the difference ΔANG. Specifically, a basic current value for operating the steering hydraulic cylinder 26 in the direction of decreasing the difference ΔANG is determined and the determined basic current value is multiplied by the gain G to determine the current value for operating the steering hydraulic cylinder 26, more exactly the drive current value of the electric motor 72.

Since, as explained above, the gain G is set or defined to decrease with decreasing engine speed NE, the current value is set or defined to decrease with decreasing engine speed NE. In other words, the output of the steering hydraulic cylinder 26 is reduced with decreasing engine speed NE. The output characteristic of the steering hydraulic cylinder 26 is set or defined in this manner because the steering load varies with the speed of the boat 12 (specifically, because the steering load decreases as the speed (water speed) of the boat 12 falls with declining engine speed NE).

Figure 8:
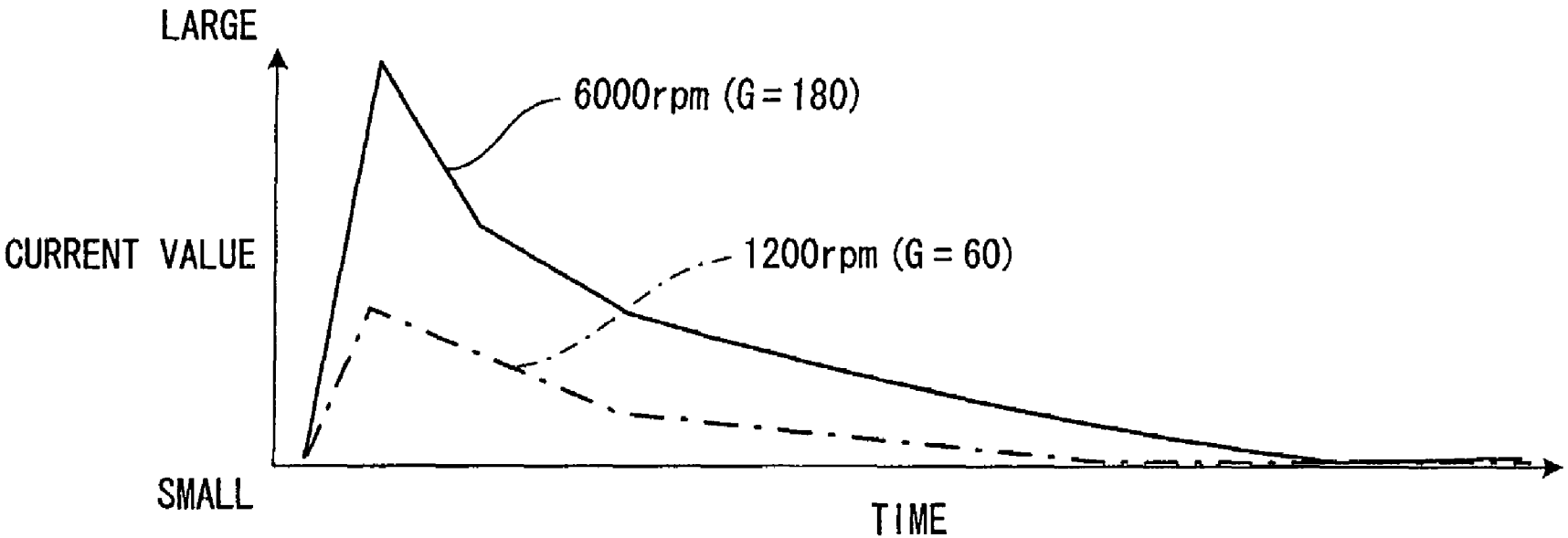
FIG. 8 is a time chart showing current values of a steering hydraulic cylinder at which a difference between a desired steering angle and an actual steered angle exhibits a certain transition in the processing of the flowchart shown in FIG. 6, by comparing when the engine speed NE is 6,000 rpm with that when it is 1,200 rpm.

FIG. 8 is a time chart comparing the current values at which the difference ΔANG exhibits a certain transition, between when the engine speed NE is 6,000 rpm and when it is 1,200 rpm. As shown, when the engine speed NE is 6,000 rpm, the gain G is set at 180. On the other hand, when the engine speed NE is 1,200 rpm, the gain G is set at 60. Therefore, the current value is set to a smaller value when the engine speed NE is 1,200 rpm than when it is 6,000 rpm. As a result, the output of the steering hydraulic cylinder 26 is smaller when the engine speed NE is 1,200 rpm than when it is 6,000 rpm.

The explanation of the flowchart of FIG. 6 will be resumed.

Next, in S20, the operation of the steering hydraulic cylinder 26 (the electric motor 72) is controlled based on the current value determined in S18. The outboard motor 10 is therefore steered to the left or right.

Thus, taking into account that steering load varies with the speed of the boat 12, the outboard motor steering system according to this embodiment of the invention is configured to detect the engine speed NE as a value indicative of the speed of the boat 12 and determine the current value for operating the steering driving the steering hydraulic cylinder 26 can therefore be determined in accordance with the steering load to reduce electric power consumption. Moreover, owing to the fact that the drive current is determined as a function of steering load, it is possible to prevent the output of the steering hydraulic cylinder 26 from becoming excessive relative to the steering load, thereby ensuring that the steered angle of the outboard motor 10 tracks the desired steering angle with good accuracy.

More specifically, since the current value for driving the steering hydraulic cylinder 26 is determined to decrease with decreasing engine speed NE (lower speed of the boat 12), the current value for operating the steering hydraulic cylinder 26 can be set to the optimum value for the steering load, thereby further reducing electric power consumption and enabling the steered angle to track the desired steering angle with still higher accuracy.

The embodiment is thus configured to have a system for steering an outboard motor (10) mounted on a stern of a boat (12) and having an internal combustion engine (30) to power a propeller (36), comprising: an actuator (steering hydraulic cylinder 26) regulating a steering angle of the outboard motor; a detector (crank angle sensor 34) detecting a speed of the boat; a current value determiner (ECU 32, S10 to S18) determining a current value to operate the actuator based on the detected speed of the boat; and an actuator controller (ECU 32, S20) controlling operation of the actuator based on the determined current value.

In the system, the current value determiner determines the current value such that the current value decreased with decreasing speed of the boat, as shown in FIG. 7.

In the system, the current value determiner includes; a desired steering angle determiner (ECU 32, S10) determining a desired steering angle based on a steered angle of a steering wheel (42) manipulated by an operator; a steered angle determiner (ECU 32, S12) determining a steered angle of the outboard motor regulated by the actuator; a difference calculator (ECU 32, S14) calculating a difference ΔANG between the desired steering angle and the determined steered angle of the outboard motor; a gain calculator (ECU 32, S16) calculating a gain based on the speed of the boat such that the gain decreases with decreasing speed of the boat; and a current value calculator (ECU 32, S18) calculating the current value based on the difference and the gain.

In the system, the actuator is a hydraulic cylinder (26) operated by an electric motor (72) and the current value determiner determines the current value to be supplied to the electric motor to operate the hydraulic cylinder.

In the system, the detector is an engine speed detector (crank angle sensor 34) that detects a speed of the engine NE corresponding to the speed of the boat.

It should be noted in the above, although the steering hydraulic cylinder 26 is used as an actuator for regulating the steering angle, another actuator such as an electric motor may instead be used.

It should also be noted in the above, although the boat speed is detected by detecting the engine speed NE, it may be immediately detected by using a boat speed sensor.

Japanese Patent Application No. 2004-256585 filed on Sep. 3, 2004 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for steering an outboard motor adapted to be mounted on a stern of a boat and having an internal combustion engine to power a propeller, comprising:

an actuator which regulates a steering angle of the outboard motor;

a detector which detects a speed of the boat;

a current value determiner which determines a current value to operate the actuator based on the detected speed of the boat; and an actuator controller which controls operation of the actuator based on the determined current value;

wherein the current value determiner determines the current value such that the current value decreases with decreasing speed of the boat.

2. The system according to claim 1, wherein the current value determiner includes;

a desired steering angle determiner which determines a desired steering angle based on a steered angle of a steering wheel manipulated by an operator;

a steered angle determiner which determines a steered angle of the outboard motor regulated by the actuator;

a difference calculator which calculates a difference between the desired steering angle and the determined steered angle of the outboard motor;

a gain calculator which calculates a gain based on the speed of the boat such that the gain decreases with decreasing speed of the boat; and a current value calculator which calculates the current value based on the difference and the gain.

3. A system for steering an outboard motor adapted to be mounted on a stem of a boat and having an internal combustion engine to power a propeller, comprising:

an actuator which regulates a steering angle of the outboard motor;

a detector which detects a speed of the boat;

a current value determiner which determines a current value to operate the actuator based on the detected speed of the boat; and an actuator controller which controls operation of the actuator based on the determined current value;

wherein the actuator is a hydraulic cylinder operated by an electric motor and the current value determiner determines the current value to be supplied to the electric motor to operate the hydraulic cylinder.

4. The system according to claim 1, wherein the detector is an engine speed detector that detects a speed of the engine corresponding to the speed of the boat.

5. A method of steering an outboard motor mounted on a stern of a boat and having an internal combustion engine to power a propeller and an actuator regulating a steering angle of the outboard motor, comprising the steps of:

detecting a speed of the boat;

determining a current value to operate actuator based on the detected speed of the boat; and controlling operation of the actuator based on the determined current value;

wherein the step of current value determining determines the current value such that the current value decreases with decreasing speed of the boat.

6. The method according to claim 5, wherein the step of current value determining includes the steps of;

determining a desired steering angle based on a steered angle of a steering wheel manipulated by an operator;

determining a steered angle of the outboard motor regulated by the actuator;

calculating a difference between the desired steering angle and the determined steered angle of the outboard motor;

calculating a gain based on the speed of the boat such that the gain decreases with decreasing speed of the boat; and calculating the current value based on the difference and the gain.

7. A method of steering an outboard motor mounted on a stern of a boat and having an internal combustion engine to power a propeller and an actuator regulating a steering angle of the outboard motor, comprising the steps of:

detecting a speed of the boat;

determining a current value to operate actuator based on the detected speed of the boat; and controlling operation of the actuator based on the determined current value;

wherein the actuator is a hydraulic cylinder operated by an electric motor and the step of current value determining determines the current value to be supplied to the electric motor to operate the hydraulic cylinder.

8. The method according to claim 5, wherein step of detecting the speed of the boat involves detecting a speed of the engine corresponding to the speed of the boat.

* * * * *